US005321220A

United States Patent [19]

Sekiguchi

[11] Patent Number: 5,321,220

[45] Date of Patent: Jun. 14, 1994

[54] PRESSURE SWITCH

[75] Inventor: Kazuo Sekiguchi, Atsugi, Japan

[73] Assignee: Unisia Jecs Corporation, Atsugi, Japan

[21] Appl. No.: 36,698

[22] Filed: Mar. 25, 1993

[30] Foreign Application Priority Data

Mar. 30, 1992 [JP] Japan ..... 4-017796[U]

[51] Int. Cl.[5] ..... H01H 35/38

[52] U.S. Cl. ..... 200/82 R; 73/745; 200/284

[58] Field of Search ..... 174/84 R, 94 R, 94 S; 73/744, 745; 307/118; 340/626; 200/81 R, 82 R, 82 B, 82 D, 82 DA, 284, 302.1

[56] References Cited

U.S. PATENT DOCUMENTS 4,694,273 9/1987 Franchino ..... 340/58

5,187,337 2/1993 Fujie et al. ..... 200/82 R

FOREIGN PATENT DOCUMENTS 2-80943 6/1990 Japan .

*Primary Examiner*—Gerald P. Tolin

*Attorney, Agent, or Firm*—Foley & Lardner

[57] ABSTRACT

A pressure switch comprises an electrically conductive housing, a stationary contact stationarily installed in the housing and a movable contact movably received in the housing. The movable contact is movable to contact with the stationary contact. A hydraulically operated moving device is employed for moving the movable contact in accordance with a hydraulic pressure applied thereto. The stationary contact is formed with a blind bore. An end piece to which an end of an electric cable has been connected is press-fitted in the blind bore.

6 Claims, 1 Drawing Sheet

PRESSURE SWITCH

BACKGROUND OF THE INVENTION

1. Field of the Invention

The present invention relates in general to pressure switches, and more particularly to pressures switches of a type which is installed in a hydraulic circuit of an automotive power steering device or the like.

2. Description of the Prior Art

One of the conventional pressure switches of the above-mentioned type is disclosed in Japanese Utility Model First Provisional Publication 2-80943.

The pressure switch of this publication comprises a cylindrical case, a plastic seal received in the case, and a switch proper held by the plastic seal. The switch proper includes a stationary contact, a movable contact, a biasing spring for biasing the movable contact toward the stationary contact and an operation pin for moving the movable contact away from the stationary contact in accordance with an oil pressure applied thereto. That is, upon application of oil pressure to the operation pin, the pin moves the movable contact away from the stationary contact to obtain "OFF" condition of the switch proper. Due to work of the biasing spring, under no pressure application to the operation pin, the movable contact is kept in contact with the stationary contact to achieve "ON" condition of the switch.

The above-mentioned conventional pressure switch has a drawback. That is, the stationary and movable contacts have respective cables which are welded thereto. These cables extend to a control unit. However, welding the cables to the respective contacts causes not only complicated construction of the switch but also troublesome assembly of the same.

SUMMARY OF THE INVENTION

It is therefore an object of the present invention to provide a pressure switch which is simple in construction and easy in assembly.

It is another object of the present invention to provide a pressure switch which is economical in production.

According to a first aspect of the present invention, there is provided a pressure switch which comprises an electrically conductive housing; a stationary contact stationarily installed in the housing; a movable contact movably received in the housing, the movable contact being movable to contact with the stationary contact means for moving the movable contact in accordance with a hydraulic pressure applied thereto; means defining in the stationary contact a blind bore; and an end piece to which an end of an electric cable is connected, wherein the end piece is press-fitted in the blind bore.

According to a second aspect of the present invention, there is provided a pressure switch which comprises an electrically conductive housing; a metal case tightly installed in the housing to leave a given space in the housing, the metal case and the housing being coupled to effect electric connection therebetween; a rod-shaped stationary contact stationarily installed in the metal case, the stationary contact having one end exposed to the given space and the other end formed with a blind bore; insulating means for achieving electric insulation between the stationary contact and the metal case; a movable contact received in the given space in a manner to be movable to contact with the one end of the stationary contact; means for defining a pin guide passage in the housing, the pin guide passage extending between the given space and a given portion to which a hydraulic pressure is applied; an operation pin slidably disposed in the pin guide passage, the pin having one end exposed to the given portion of the pin guide passage and the other end engaged with the movable contact; a metal spring compressed between the movable contact and the metal case to bias the movable contact away from the stationary contact, the metal spring, the movable contact and the metal case being assembled to achieve an electric connection therebetween; an end piece to which an end of an electric cable is connected, the end piece being press-fitted to the blind bore of the other end of the rod-shaped stationary contact; and a plastic seal contained in the metal case to sealingly hold the stationary contact.

BRIEF DESCRIPTION OF THE SINGLE DRAWING

Other objects and advantages of the present invention will become apparent from the following description when taken in conjunction with the accompanying single drawing, in which:

FIG. 1 is a sectional view of a pressure switch according to the present invention.

DETAILED DESCRIPTION OF THE INVENTION

Figure 1:
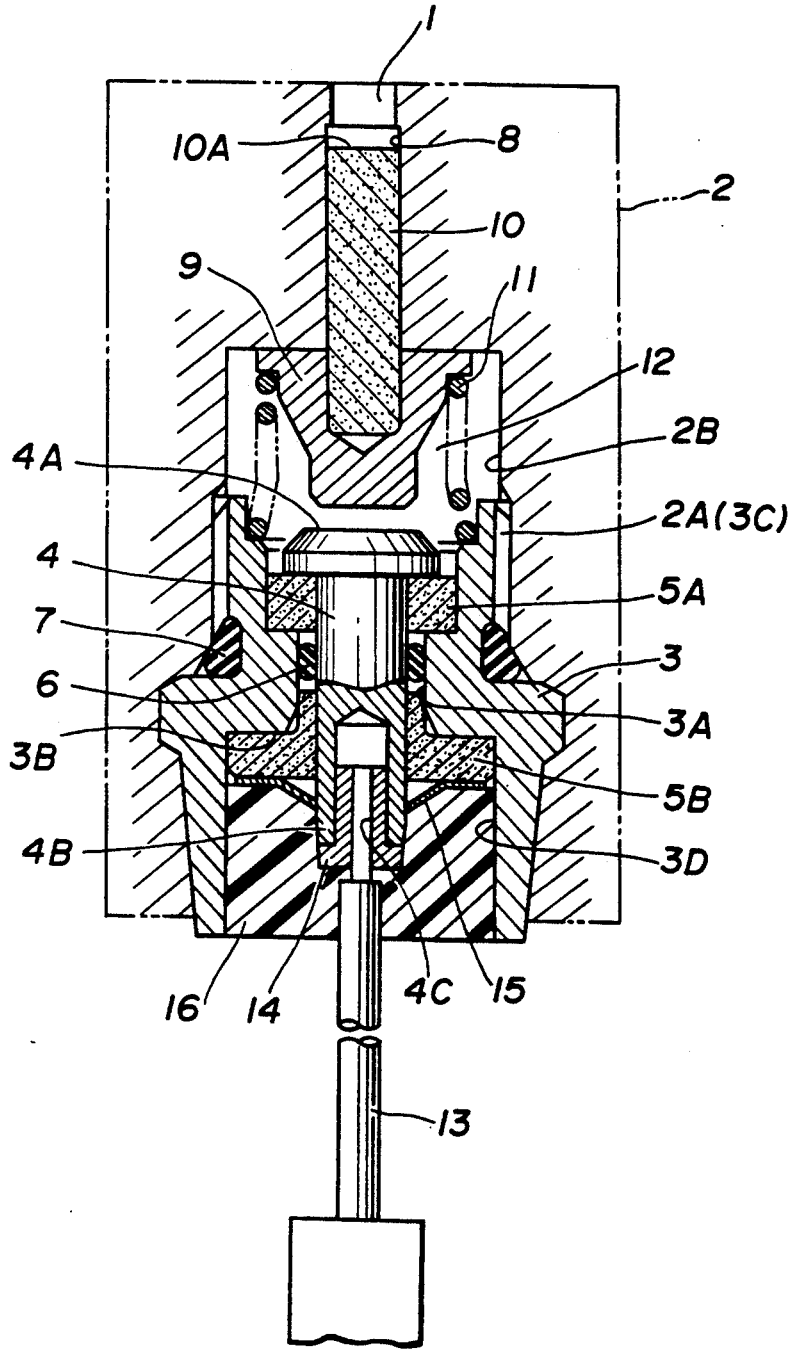

Referring to the single drawing (FIG. 1), there is shown a pressure switch of the present invention.

The pressure switch shown in the drawing is of a so-called "body-earth" type having a single terminal and is applied to an automotive power steering system. That is, as shown, the pressure switch is installed in an oil passage 1 which leads to an oil pump (not shown) of the power steering system. When the pressure switch takes "ON" (or closed) position, a control unit (not shown) operates to increase the engine speed. That is, when, due to operation of the power steering, the load of the oil pump is increased to a level of inducing possibility of an engine stall, and when the pressure in the oil passage 1 exceeds a given level, the pressure switch is turned ON to increase the rotation speed of the engine. With this, the undesired engine stall is suppressed.

The pressure switch of the invention comprises an electrically conductive housing 2 which is body-earthed. The housing 2 has a generally cylindrical bore 2B therein. The bore 2B has at a longitudinally middle part a threaded portion 2A. Designated by numeral 3 is a generally cylindrical metal case of a pressure switch proper, which is installed in the bore of the housing 2. The case 3 has a threaded portion 3C tightly engaged with the threaded portion 2A, as shown. A stationary contact 4 in the shape of rod is tightly held by the case 3. That is, the case 3 has a center bore 3A in which the rod-shaped stationary contact 4 is tightly received with an interposal of first and second annular insulators 5A and 5B therebetween. An O-ring 6 is tightly disposed between a reduced part of the center bore 3A and the rod-shaped stationary contact 4. Designated by numeral 7 is another O-ring which is tightly disposed between the case 3 and the housing 2, as shown.

The housing 2 is formed with a pin guide passage 8 which communicates the oil passage 1 with the cylindrical bore 2B of the housing 2. As shown, the pin guide passage 8 is shaped concentric with the oil passage 1 connected thereto. Within the pin guide passage 8, there is axially slidably disposed an operation pin 10 which has one end 10A exposed to the oil passage 1 and the other end projected into a clearance 12 which is left at an upper portion, as viewed in the drawing, of the cylindrical bore 2B. For achieving smoothed movement in the pin guide passage 8, the operation pin 10 is constructed of ceramic or the like, which is light in weight. Of course, metal pin is also usable. The inwardly projected end of the operation pin 10 is equipped with a movable contact 9 which faces a front end 4A of the stationary contact 4. A metal coil spring 11 is compressed between the movable contact 9 and the case 3, so that under rest condition, the movable contact 9 is kept away from the front end 4A of the stationary contact 4.

In the present invention, the following measure is employed for achieving simple construction of the pressure switch.

That is, as shown in the drawing, the lower end portion of the rod-shaped stationary contact 4 is formed with a blind bore 4C. Thus, a cylindrical wall is defined about the blind bore 4C, which is designated by reference 4B. Within the blind bore 4C, there is press-fitted an electrically conductive end piece 14 to which an electric cable 13 has been fixed by caulking the end piece 14. The cable 13 leads to a control unit (not shown).

As shown, the second annular insulator 5B is received in an enlarged lower portion 3D of the center bore 3A of the case 3. The second annular insulator 5B has a shoulder portion which abuts against an inwardly projected wall 3B of the center bore 3A. A push nut 15 is operatively installed between the bored lower end portion 4B of the rod-shaped stationary contact 4 and the second annular insulator 5B for assuring the abutment of the second annular insulator 5B against the projected wall portion 3B. The remaining part of the enlarged lower portion 3D of the center bore 3A is filled with a plastic seal 16 by which the push nut 15, the bored lower end portion 4B of the stationary contact 4 and part of the cable 13 are tightly held.

In the following, operation of the pressure switch of the invention will be described.

Under rest condition, the pressure switch assumes the illustrated condition wherein the movable contact 9 is kept away from the front end 4A of the stationary contact 4 due to work of the biasing spring 11. Thus, under this condition, the switch takes "OFF" position.

While, when, due to increase in pressure from the oil pump, the pressure in the oil passage 1 increases and exceeds a predetermined level, the operation pin 10 is moved downward, as viewed in the drawing, against the biasing force of the coil spring 11, and thus, finally, the movable contact 9 is brought into contact with the front end 4A of the stationary contact 4. With this, "ON" condition of the pressure switch is established. Upon this "ON" condition, an electric circuit is established which comprises the cable 13, the stationary contact 4, the movable contact 9, the coil spring 11, the case 3 and the body-earthed housing 2. Thus, the control unit increases the engine speed for suppressing the engine stall.

Although the above-description is directed to a structure in which only one stationary contact is used, the present invention is also applicable to another structure in which a plurality of stationary contacts are used.

As has been described hereinabove, in the pressure switch of the present invention, the connection of the stationary contact 4 to the control unit is achieved by only press-fitting the end piece 14 of the cable 13 into the blind bore 4C of the stationary contact 4, and the connection of the movable contact 9 to the control unit is achieved by the body-earth system without using any electric cable. Thus, the pressure switch of the invention can be simple in construction, easy in assembly and economical in production.

What is claimed is:

1. A pressure switch comprising:

an electrically conductive housing;

a stationary contact stationarily installed in said housing;

a movable contact movably received in said housing, said movable contact being movable to contact with said stationary contact;

means for moving said movable contact in accordance with a hydraulic pressure applied thereto;

means defining in said stationary contact a blind bore; and an end piece to which an end of an electric cable is connected, wherein said end piece is press-fitted in said blind bore.

2. A pressure switch as claimed in claim 1, further comprising:

a metal case tightly installed in said housing and tightly receiving therein said stationary contact, said metal case and said housing being coupled to achieve an electric connection therebetween;

insulating means for achieving electric insulation between said stationary contact and aid metal case; and a metal spring compressed between said movable contact and said metal case to bias said movable contact away from said stationary contact, said metal spring, said movable contact and said metal case being assembled to achieve an electric connection therebetween.

3. A pressure switch as claimed in claim 2, in which said metal case contains therein a plastic seal by which the bored part of said stationary contact to which said end piece is fitted is tightly and sealingly held.

4. A pressure switch as claimed in claim 3, in which said means for moving said movable contact comprises:

means for defining a pin guide passage in said housing, said pin guide passage having a given portion to which said hydraulic pressure is applied;

an operation pin axially slidably disposed in said pin guide passage, said pin having one end exposed to said given portion of said pin guide passage and the other end engaged with said movable contact.

5. A pressure switch as claimed in claim 4, in which said operation pin is constructed of ceramic material.

6. A pressure switch comprising:

an electrically conductive housing;

a metal case tightly installed in said housing to leave a given space in said housing, said metal case and said housing being coupled to effect electric connection therebetween;

a rod-shaped stationary contact stationarily installed in said metal case, said stationary contact having one end exposed to said given space and the other end formed with a blind bore;

insulating means for achieving electric insulation between said stationary contact and said metal case;

a movable contact received in said given space in a manner to be movable to contact with said one end of said stationary contact;

means for defining a pin guide passage in said housing, said pin guide passage extending between said given space and a given portion to which a hydraulic pressure is applied;

an operation pin slidably disposed in said pin guide passage, said pin having one end exposed to said given portion of said pin guide passage and the other end engaged with said movable contact;

a metal spring compressed between said movable contact and said metal case to bias said movable contact away from said stationary contact, said metal spring, said movable contact and said metal case being assembled to achieve an electric connection therebetween;

an end piece to which an end of an electric cable is connected, said end piece being press-fitted to said blind bore of the other end of the rod-shaped stationary contact; and a plastic seal contained in said metal case to sealingly hold said stationary contact.

* * * * *